United States Patent [19]

Shumaker

[11] Patent Number: 4,609,303

[45] Date of Patent: Sep. 2, 1986

[54] SLIP-FORM FOR CONCRETE PATHWAYS

[76] Inventor: O. R. Shumaker, 9217 Parkside Dr., Sun Lakes, Ariz. 85224

[21] Appl. No.: 645,521

[22] Filed: Aug. 28, 1984

Related U.S. Application Data

[63] Continuation of Ser. No. 328,244, Dec. 7, 1981.

[51] Int. Cl.[4] ..... E01C 19/22

[52] U.S. Cl. ..... 404/105; 404/96; 404/101

[58] Field of Search ..... 404/72, 82, 96, 98, 404/101, 104, 105, 108, 110, 118; 425/63

[56] References Cited

U.S. PATENT DOCUMENTS

| | | | |
|---|---|---|---|
| 2,197,878 | 4/1940 | Robinson | 404/105 X |
| 2,664,794 | 1/1954 | Evans | 404/105 |
| 3,182,410 | 5/1965 | Schiavi | 404/96 X |
| 3,423,492 | 1/1969 | Jonell et al. | 425/63 X |
| 3,442,189 | 5/1969 | Robinson et al. | 404/105 |
| 3,456,566 | 7/1969 | Lazaro | 404/108 |
| 3,468,001 | 9/1969 | Bodine, Jr. | 425/63 |
| 3,477,354 | 11/1969 | Rink | 404/105 |
| 3,566,760 | 3/1971 | Lafleur et al. | 404/98 |
| 3,685,405 | 8/1972 | McDonald et al. | 404/105 |
| 3,779,661 | 12/1973 | Godbersen | 404/72 |
| 3,957,405 | 5/1976 | Goughnour | 404/105 X |

*Primary Examiner*—James A. Leppink
*Assistant Examiner*—Matthew Smith
*Attorney, Agent, or Firm*—Nixon & Vanderhye

[57] ABSTRACT

Device for slip forming concrete pathways such as golf cart paths, driveways, sidewalks and the like. A concrete slip form is continuously moved forward to form concrete aggregate into a smooth, uniform member, and comprises a mold member having an open end for receiving the concrete aggregate and a lower end for discharging the aggregate; means for moving the mold member to effect the discharge of the concrete member; means for forming and contouring the ground surface prior to pouring the aggregate; and means for compacting and smoothing the concrete aggregate prior to discharge from the mold.

6 Claims, 8 Drawing Figures

SLIP-FORM FOR CONCRETE PATHWAYS

This is a continuation of application Ser. No. 328,244, filed Dec. 7, 1981 abandoned,

BACKGROUND AND SUMMARY OF THE INVENTION

The present invention relates to a new and useful improvement in apparatus for forming concrete members and, more particularly, to a slip-forming device for continuously pouring and forming concrete pathways such as golf cart paths, driveways, sidewalks and the like.

In the art of slip-forming concrete, a mold is employed to form the concrete aggregate to a desired shape and, as the concrete is poured and begins to settle, the mold is moved forward at a constant pace permitting the concrete to "slip" from the mold under its own weight by gravity flow. The use of such molds allows concrete members of relatively uniform shape to be continuously formed having the cross-sectional configuration of the mold. The principal advantage of slip-forming, as opposed to more conventional concrete-forming methods, is that it eliminates the costly labor and materials necessary to construct, assemble and dismantle wooden or metal forms which normally are required to restrain the sides of the concrete after pouring.

A critical problem with prior art slip-forming devices used in the construction of concrete pathways is that the concrete that is discharged from such devices tends to crack or fracture, particularly at the outside edges, shortly after the pouring and forming operations. The tendency to crack during setting is particularly acute in applications requiring a concrete aggregate that contains an amount of water sufficient to ensure the formation of a smooth surface as the concrete member is being discharged from the form. The cracking problem associated with such pathways also appears to be more severe in climates having high temperatures and relatively low humidities such as those in the southwestern part of the United States. Frequently, an entire concrete section must be removed and repoured due to the cracking and/or fragmentation following setting.

Although it is known that chemical or oil-base curing agents may be applied to hand-formed concrete members following pouring in order to minimize cracking, such agents are relatively ineffective in slip-forming operations and add to the overall cost per foot of concrete construction. Thus, concrete pathways formed using prior art slip-forming devices invariably must be hand-finished for resurfaced using conventional hand trowelling or finishing equipment in order to provide a uniform, smooth surface or to eliminate cracks forming during setting. The additional cost in labor and materials necessary to complete such refinishing operations has made concrete far less economical as a construction medium for golf cart paths, driveways and other flat or crowned surfaces which do not require steel reinforcing.

One solution to the cracking problem which has been adopted by prior art devices is to lower the water-to-cement ratio of the aggregate while employing means to vigorously vibrate or agitate the concrete mix prior to and immediately after the initial pour. Such agitation techniques have been somewhat successful in allowing for the formation of a smooth surface while avoiding the cracking problems attendant non-vibration slip-forming apparatus. However, in addition to their increased expense, complexity and maintenance requirements, such devices are often considered less desirable than hand-forming operations due to their inherent lack of consistency and because of the increased wear resulting from the use of auxiliary vibration apparatus during the pouring operation. In addition, such devices do not lend themselves to applications requiring frequent changes in direction such as, for example, in the formation of golf cart paths. Typical prior art devices exhibiting such deficiencies are disclosed in U.S. Pat. Nos. 3,954,359, 3,468,001, 4,027,990, 3,423,492, and 2,664,794.

Thus, although it is known that vibration in combination with means for compression of the concrete will facilitate the formation of a smooth surface, the prior art techniques requiring vibration present quality control and efficiency problems which continue to plague the concrete art.

It has now been found that the recurring problems of cracking and deterioration associated with conventional slip-forming devices may be eliminated by a unique design configuration for a slip-forming mold which allows for the removal of vibration means altogether. In particular, it has been discovered that a specific combination of weight and design features will allow the aggregate to be continuously compressed, settled and smoothed without requiring auxiliary vibration apparatus. It has also been found that a certain consistency of concrete aggregate used in the method according to the invention tends to reduce the possibility of cracking or fracture, while ensuring that the finished members are formed having a uniform thickness and smooth surface.

The slip-form apparatus constructed in accordance with the present invention ensures that the formed concrete aggregate will not require subsequent hand trowelling, finishing, or curing operations and thus permits a substantial reduction in the cost of producing concrete pathways. It also eliminates any need to construct conventional metal or wooden forms prior to pouring.

Accordingly, it is an object of the present invention to provide for a concrete slip-forming device which will allow for the formation of concrete members having substantially uniform thickness and smooth surfaces while ensuring that such members will not crack or deteriorate during setting. It is a further object of the invention to provide a slip form which will allow concrete pathways to be continuously formed without additional hand trowelling, finishing or curing operations following the initial pour. It is still another object of the present invention to provide a method for continuously forming concrete pathways which will not crack or deteriorate and which do not require conventional vibration means.

Finally, it is an object of the present invention to provide a method for forming concrete pathways that is considerably more cost-efficient and economical than conventional prior art techniques.

Other features, objects and advantages of the subject invention will appear more fully from the following description of illustrative embodiments taken in conjunction with the appended drawings.

DETAILED DESCRIPTION OF THE DRAWINGS

Figure 1:
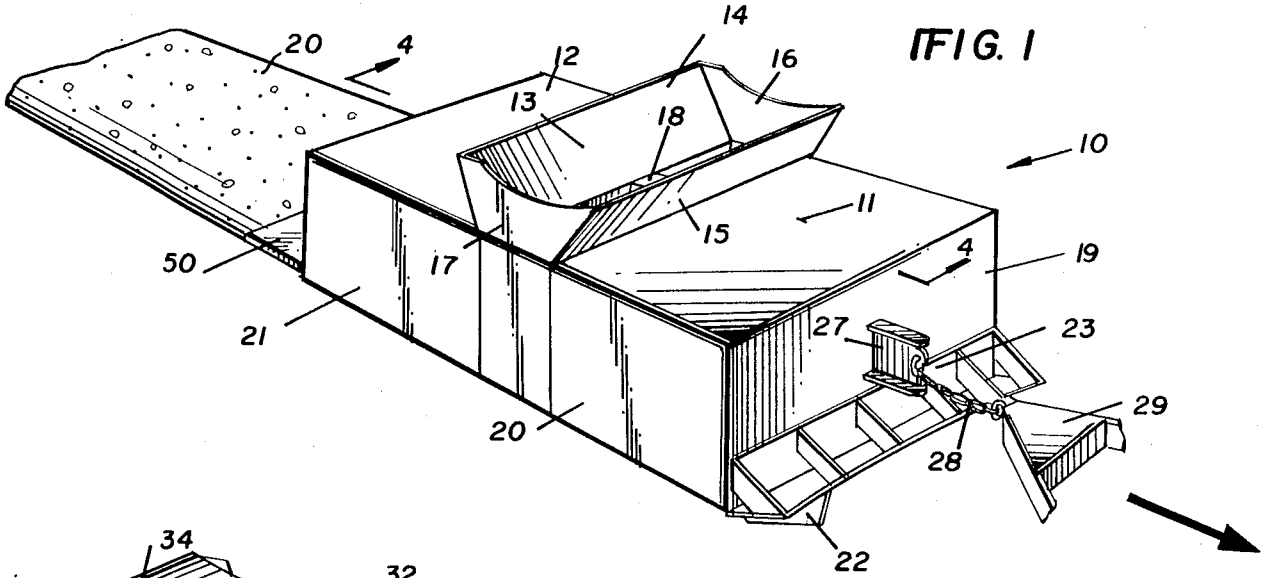
FIG. 1 is a perspective view of exemplary apparatus according to the present invention as shown during a typical pouring and forming operation.

Referring to FIG. 1, a slip form constructed in accordance with the present invention is shown generally at 10 and comprises front and rear forming chambers 11 and 12, respectively, separated substantially at their mid-point by concrete aggregate feed hopper 13. The feed hopper is constructed such that it forms an open passageway directly to the ground surface and is sized to receive concrete aggregate poured, for example, from a concrete mixing truck. The aggregate is thus continuously fed to the slip form where it passes by gravity flow under rear chamber 12 as the form is being moved forward. As FIG. 1 indicates, feed hopper 13 preferably is constructed in a modified funnel configuration in order to receive and distribute the concrete uniformly beneath rear chamber 12. Thus, the hopper comprises side panels 14 and 15 which are permanently affixed to the tops of chambers 11 and 12, respectively, at approximately a 60° angle relative to the top of the form. The feed hopper end portions are depicted at 16 and 17 and chambers 11 and 12 are joined to form an integral structure by virtue of the structural support member shown on FIG. 1 as item 18. Both chambers are enclosed at the sides and front by the rectangular panels as shown by 19, 20 and 21.

As concrete aggregate is being poured into feed hopper 13, the entire form is moved forward at a constant pace, allowing a smooth member of uniform thickness and configuration to be continuously discharged from the rear of the form. As indicated above, the combination of weight (as translated into a compressive force) coupled with the unique design configuration of the bottom surface of the forming chambers mold the aggregate into the smooth member depicted as item 20. FIG. 1 also shows the use of a rubber screed 50 permanently affixed to the bottom rear portion of chamber 12. During normal operation, the screed, in addition to assisting in smoothing the concrete as it discharges from the form, serves to eliminate any surface "bubbling" of the newly-poured concrete.

The form may be moved in the direction shown by the arrow on FIG. 1 by a bulldozer or comparable earth-moving machinery. As it moves forward, a front contouring plow blade 23 serves to smooth and grade the ground surface (as does the bottom surface of front chamber 11) immediately prior to the pouring step. Concurrently, two identical peripheral plow blades (shown by example as 22 on FIG. 1) on each side of contouring blade 23 divert any remaining earth or rocks away from the immediate area of the pathway being formed. The entire slip form device may be connected to the bulldozer by means of the forwardly projecting flanges shown at 27, which connect by virtue of chain 28 to the rear of the bulldozer as shown at 29.

Figure 2:
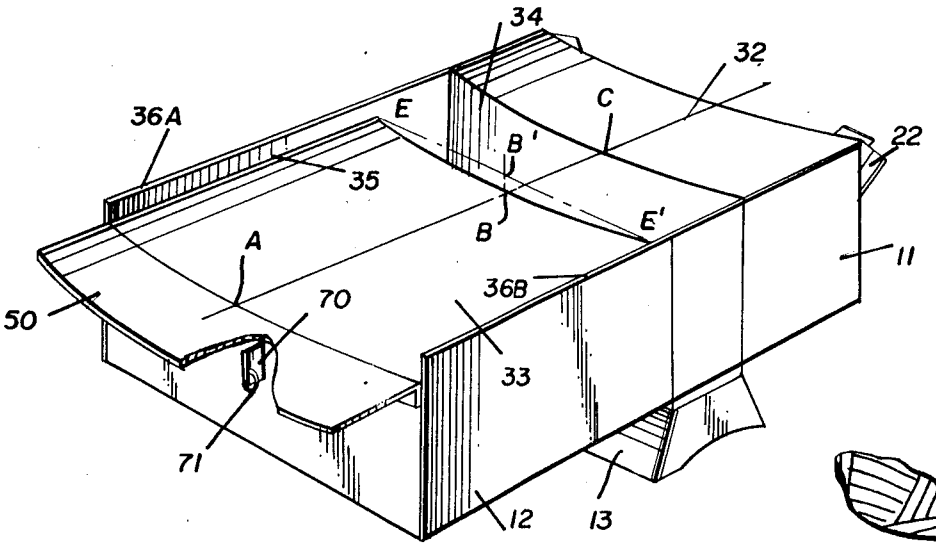
FIG. 2 is a perspective view showing the bottom surface of the slip form depicted in FIG. 1.

With particular reference to FIG. 2, the underside surface of chambers 11 and 12 is shown as having bottom plates 32 and 33, respectively. As FIG. 2 makes clear, plates 32 and 33 have a curved configuration and are joined to the vertical portions of chambers 11 and 12 at their edges as shown at 35. As such, bottom plates 32 and 33 serve to uniformly distribute the weight of the slip form as it passes over the concrete, and to thereby compress and form the concrete aggregate into a uniform member having a smooth, crown-like surface for use, for example, as a golf cart pathway. FIG. 2 also shows the lower end of feed hopper 13 opening to the ground surface. The interior of the hopper is comprised of four rectangular panels as shown by way of example as item 34. FIG. 2 also depicts the side panels of rear chamber 12 extending below the level of curved bottom plate 33 approximately to a depth equivalent to the concrete pathway being poured, leaving lips 36A and 36B extending perpendicular to bottom sheet 33 by the same depth. Finally, FIG. 2 shows means for lifting the entire slip form by way of anchor brace 70 and lifting lug 71.

Figure 3:
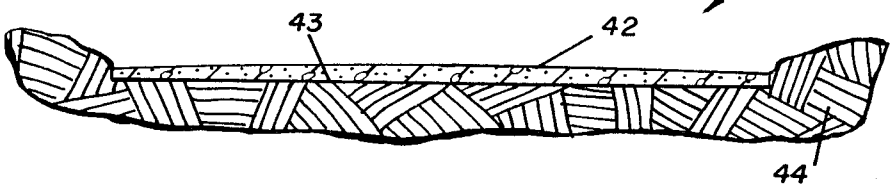
FIG. 3 is a cross-sectional view of a concrete pathway produced by the method and apparatus according to the invention.

With particular reference to FIG. 3, a concrete pathway formed by employing the method according to the present invention is shown generally at 60. Prior to pouring the concrete aggregate, ground surface 64 is graded and contoured into a crown-like configuration using the plow member depicted in FIGS. 7 and 8. Inasmuch as the non-uniformity of thickness of the concrete member may contribute to the cracking problems during setting, the ground surface should be graded in a configuration substantially similar to the concrete member itself. Thus, as FIG. 3 makes clear, concrete pathway 61 is formed of uniform thickness having crowned top and bottom surfaces shown at 62 and 63, respectively.

Figure 4:
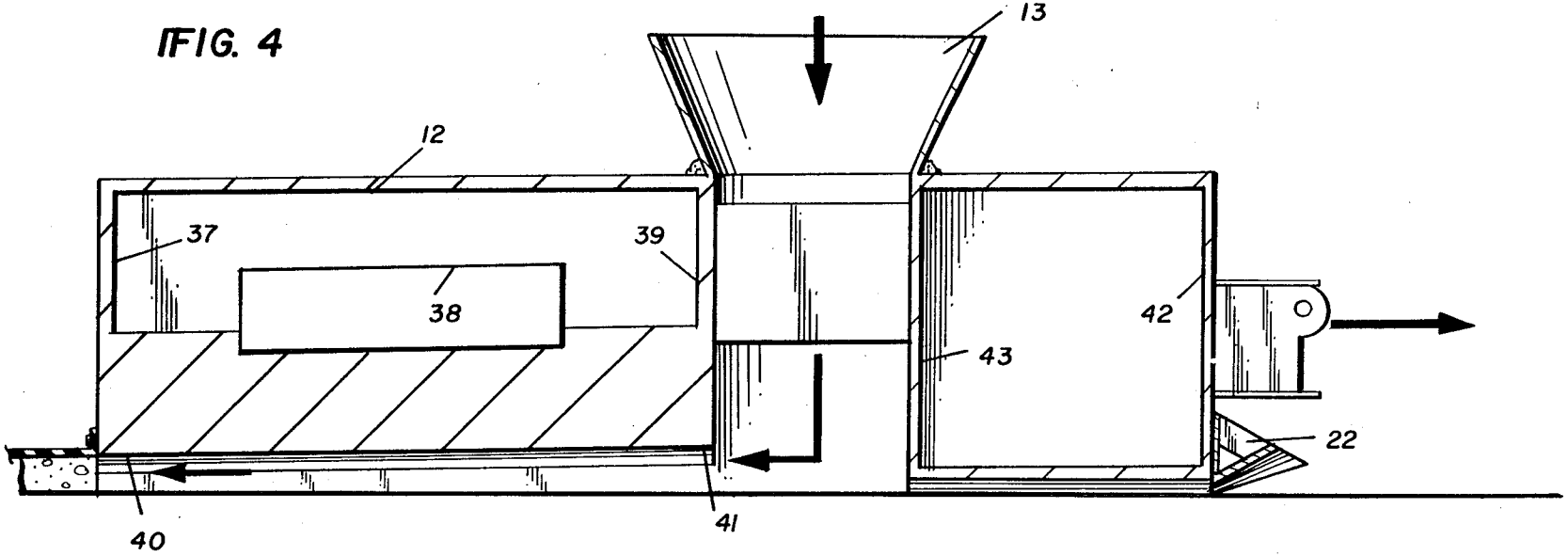
FIG. 4 is a side elevation view of the slip form taken along line 4—4 on FIG. 1.

With particular reference to FIG. 4, the arrows indicate the gravity flow pattern of concrete aggregate down hopper 13 and under chamber 12 as the slip form moves forward. Rear chamber 12 is shown in cross-section having panels 37 and 39 as the front and rear sections of the chamber. Rear chamber 12 is also shown containing a fixed weight 38 which, together with the weight of the form itself, serves to compress and settle the aggregate as it flows under rear chamber 12. In this regard, it has been found that a weight of approximately 500 pounds is generally sufficient for the formation of concrete pathways having a thickness of less than 6 inches and a width of approximately six feet. Front chamber 11 is constructed of rectangular panels shown at 42 and 43 but does not require any additional weighted material.

As indicated previously, it has been found that certain desired concrete aggregate consistencies are highly compatible with the use of a slip form constructed in accordance with the invention. In particular, a water-to-cement ratio termed by those skilled in the art as "3" SLUMP" has been found acceptable for the production of a concrete pathways having widths of 6 feet or less.

FIG. 4 also indicates that underside panel 33 of rear chamber 12 is formed such that during operation, rear portion 40 sits at a lower angle than the front portion adjacent to the feed hopper as shown at 41. This sloping configuration of panel 33 tends to further compact the concrete aggregate as the form moves forward and is essential in settling and forming the concrete into a smooth, uniform configuration. The slope differential will, of course, vary depending upon the desired application. For example, in the case of a golf cart path having a width of approximately 6 feet, it has been found that a differential of ¾" over a distance of four feet will ensure the formation of a compact, uniform, smooth surface.

Figure 5:
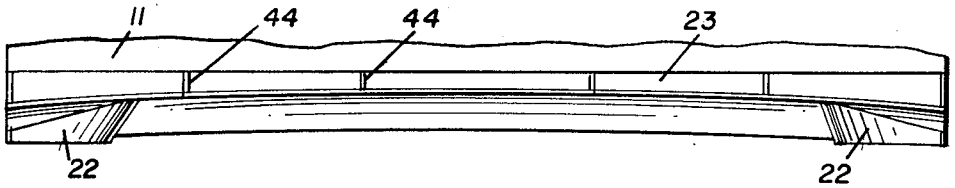
FIG. 5 is a front elevation view of the lower front portion of the slip form shown in FIG. 1.

FIG. 5 depicts the front portion of front chamber 11 showing peripheral plow blades 22 disposed at the outside edge of contouring blade 23 which serve to divert any unplowed earth away from the pathway as the form is being pulled forward. As indicated above, this front portion of chamber 11 likewise is formed in a crown-like configuration to assist in forming the ground surface immediately prior to the pour. FIG. 5 also depicts the structural supports for the plow as shown by way of example as item 44.

Figure 6:
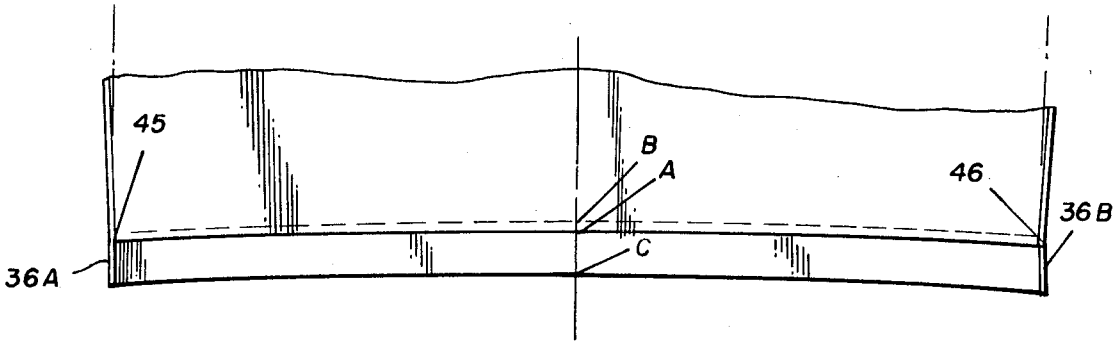
FIG. 6 is a rear elevation view showing the lower rear portion of the slip form depicted in FIG. 1.

A detail of the bottom portion of the slip form constructed in accordance with the present invention is shown in FIG. 6. Although both bottom panels of the front and rear chambers are formed in a crown configuration, it has been found that slight differences in curvature (arch) at various points on such panels contributes significantly to the efficient compression, settling and smoothing operations of the form.

For example, with respect to pathways of up to six inches in thickness and six feet in width, plate 33 has a uniformly curved configuration extending between lips 36A and 36B of rear chamber 12, where the curvature of the plate 33 reaches its highest arch at point B shown in FIG. 6 (shown also in FIG. 2). Measured vertically from the midpoint of plate 33 to point B' (which is midway between lip extensions 36A, 36B of rear forming chamber 12 in horizontal line E—E' shown in FIG. 2), the vertical distance, i.e. maximum depth of the concave archway should be approximately 1½ inches, while the maximum depth of the concave archway at pionts A and C should be about one inch.

The depth of the concrete pathway which is actually formed in measured by the lip extensions 36A and 36B of the side panels on rear chamber 12. In this regard, the compacting, settling and smoothing operation of the slip form is substantially enhanced if side members 36 and 37 are narrowed slightly toward the rear of chamber 12 as depicted at points 45 and 46. (Shown also on FIG. 2) Likewise, bottom plate 33 is slightly narrowed at the discharge end of the form. Thus, as those skilled in the art can appreciate, the geometric form of bottom plate 33 is actually that of a trapezoid, having a curvature differential between its front and rear portions. Again, the degree of narrowing will vary depending on the particular pathway being formed, however, it has been found that a difference of ½ inch to ¾ inch between the width of plate 33 at the discharge end and the end abutting feed hopper 13 is sufficient for concrete pathways of up to 6 feet in width.

Figure 8:
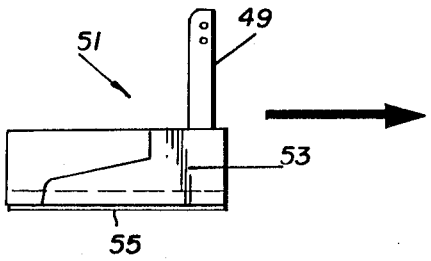
FIG. 8 is a side elevation view of the plow device depicted in FIG. 7.
Figure 7:
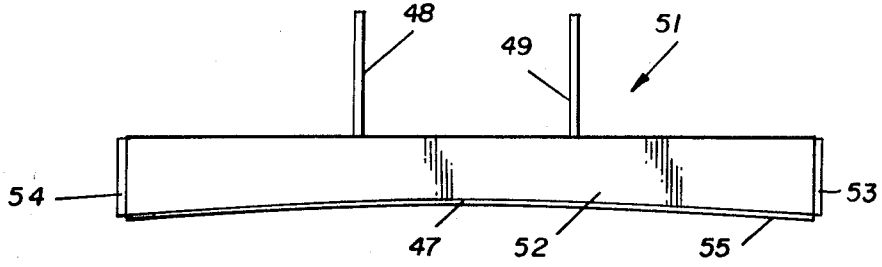
FIG. 7 is a front elevation view of the plow device used in carrying out the method according to the present invention.

FIGS. 7 and 8 depict the plow device 51 used immediately prior to the pouring operation and comprises a front blade 52 permanently affixed to side plates 53 and 54 and bottom grading plate 55. As indicated above, bottom plate 55 has a configuration (shown at 47) that is substantially similar to the surface of the pathway itself. The plow may be bolted to a standard bulldozer or other earth-moving equipment by virtue of members 48 and 49 , and is thus used to smooth and grade the ground surface into a curved configuration prior to use of the slip form itself.

While the invention herein is described in what is presently considered to be a practical preferred embodiment thereof, it will be apparent that many modifications may be made within the scope of the invention, which scope is to be accorded the broadest interpretation of the appended claims so as to encompass all equivalent methods and apparatus.

What is claimed is:

1. A device for the continual slip-forming of concrete aggregate pathways upon a soil surface comprising a slip-forming body adapted to being conveyed in a forming direction across the surface of the soil, said slip-forming body including:

a forward soil-shaping portion;

a rearward concrete aggregate-shaping portion;

means rigidly joining said forward and rearward portions so that said forward portion is separated from said rearward portion in said forming direction to thereby establish a feed chamber;

said forward portion including means defining a first surface which is smoothly and concavely curved about an axis parallel to said forming direction to initially contour the soil in response to conveyance of said device in said forming direction so as to establish a soil surface which is smoothly convexly curved about said axis;

said rearward portion including a leading edge, a trailing edge and means defining a second surface rearwardly of said first surface between said leading and trailing edges, said second surface being smoothly and concavely curved about said axis and also downwardly and rearwardly sloped between said leading and trailing edges relative to said forming direction, said trailing edge being vertically spaced above said convexly-curved soil surface so as to establish therewith a space corresponding substantially to a cross-sectional dimension of said formed pathway.

said rearward portion also including a pair of side walls which laterally bound said space thereby together defining the lateral extent of the formed pathway relative to said forming direction, wherein said feed chamber permits the introduction of said aggregate concrete directly upon said convexly-curved soil surface which has been initially convexly contoured by means of said first surface; and wherein said second surface defining means compacts and compresses said aggregate concrete introduced via said feed chamber, as said slip-forming body is conveyed in said forming direction, by virtue of said downwardly and rearwardly sloped orientation of said second surface relative to said forming direction to thereby continually form, at said trailing edge, said aggregate concrete pathway having a substantially uniform convexly curved cross-section conforming to said convexly curved soil surface by virtue of said concavely-curved second surface being vertically spaced thereabove.

2. A device as in claim 1 wherein said forward soil-shaping portion includes plow means rigidly carried in advance of said slip-forming body for assisting in the contouring of the soil surface.

3. A device as in claim 2 wherein said plow means includes a pair of plow blades forwardly and inwardly extending relative to said forming direction.

4. A device as in claim 1 wherein said second surface is downwardly sloped about $\frac{3}{4}$ inches over a distance of four feet between said leading and trailing edges.

5. A device as in claim 1 wherein said second surface is narrower at said trailing edge as compared to said leading edge.

6. A device as in claim 1 wherein said slip-forming body further includes a fixed weighted material.

* * * * *